United States Patent [19]

Sudo et al.

[11] 4,388,122

[45] Jun. 14, 1983

[54] METHOD OF MAKING HIGH STRENGTH HOT ROLLED STEEL SHEET HAVING EXCELLENT FLASH BUTT WELDABILITY, FATIGUE CHARACTERISTIC AND FORMABILITY

[75] Inventors: Masatoshi Sudo; Shunichi Hashimoto; Shoji Kambe, all of Kobe, Japan

[73] Assignee: Kabushiki Kaisha Kobe Seiko Sho, Kobe, Japan

[21] Appl. No.: 289,280

[22] Filed: Aug. 3, 1981

[30] Foreign Application Priority Data

| | | | |
|---|---|---|---|
| Aug. 11, 1980 | [JP] | Japan | 55-110829 |
| Dec. 15, 1980 | [JP] | Japan | 55-177841 |
| Dec. 15, 1980 | [JP] | Japan | 55-177842 |

[51] Int. Cl.[3] ..... C21D 8/02

[52] U.S. Cl. ..... 148/12 F; 148/12.4; 148/36

[58] Field of Search ..... 148/36, 12 C, 12 F, 148/12.4

[56] References Cited

U.S. PATENT DOCUMENTS

| | | | |
|---|---|---|---|
| 3,539,404 | 11/1970 | DeRetana | 148/12.4 |
| 4,072,543 | 2/1978 | Coldren et al. | 148/36 |
| 4,184,898 | 1/1980 | Ouchi et al. | 148/36 |
| 4,188,241 | 2/1980 | Watanabe et al. | 148/12 F |
| 4,316,753 | 2/1982 | Kaneko et al. | 148/36 |

FOREIGN PATENT DOCUMENTS

| | | | |
|---|---|---|---|
| 53-119219 | 10/1978 | Japan | 148/12 F |
| 54-66323 | 5/1979 | Japan | 148/12 F |
| 54-131525 | 10/1979 | Japan | 148/12 C |

*Primary Examiner*—Peter K. Skiff

*Attorney, Agent, or Firm*—Oblon, Fisher, Spivak, McClelland & Maier

[57] ABSTRACT

A high strength hot rolled steel sheet having excellent flash butt weldability, fatigue characteristic and formability, has a composite structure composed of polygonal ferrite and bainite and containing from 0.01 to 0.15% by weight of C, from 0.01 to 1.5% by weight of Si and from 0.3 to 2.0% by weight of Mn, the rest being Fe and impurities, the areal ratio of the bainite being from 3 to 60%. The steel sheet is suitable as a material for wheel rims or discs for automobiles.

10 Claims, 4 Drawing Figures

METHOD OF MAKING HIGH STRENGTH HOT ROLLED STEEL SHEET HAVING EXCELLENT FLASH BUTT WELDABILITY, FATIGUE CHARACTERISTIC AND FORMABILITY

BACKGROUND OF THE INVENTION

1. Field of the Invention

The present invention relates to a high strength hot rolled steel sheet having excellent flash butt weldability, fatigue characteristic and formability, which is useful for automobile parts such as wheel rims, discs or bumpers. It also relates to a process for producing such a steel.

2. Description of the Prior Art

As a measure to reduce the weight of automobile bodies for saving costs for fuels, there has been an attempt to modify the material by employment of a high strength steel material, coupled with an attempt to reduce the size of automobile bodies. A highly effective way for the saving of fuel costs is to reduce the weight of automobile wheels, and extensive studies are being made on the use of a high strength hot rolled steel sheet for the wheel rims and discs. For instance, in the United States, a composite structural type hot rolled steel sheet composed of ferrite plus martensite (i.e. dual phase steel sheet) is regarded to be most suitable, and trial tests thereon are being carried out. However, there are certain problems with respect to the characteristics of the material, and there has not yet been a practical application thereof.

Namely, the above mentioned dual phase steel sheet has difficulties such that when it is applied to a wheel disc, fractures are likely to occur at the bore-expanded portion at the time of forming, and it is inferior in the formability, especially in the stretch-flanging property. Further, its fatigue characteristic is not good enough. In its application to a wheel rim, there is a problem such that the portion affected by the welding heat during flash butt welding tends to soften and during the subsequent forming step, necking or fracture is likely to start from this portion.

As references of interest, there are U.S. Pat. No. 3,902,927 to Pernstal and U.S. Pat. No. 3,930,907 to Baily.

SUMMARY OF THE INVENTION

It is an object of the present invention to overcome the difficulties inherent to the above mentioned dual phase steel as a high strength hot rolled steel sheet to be used for wheel rims, discs and the like, and to provide a high strength hot rolled steel sheet having good flash butt weldability, fatigue characteristic and formability, especially stretch-flanging property, and a process for its production.

Thus, the present invention provides a high strength hot rolled steel sheet with excellent flash butt weldability, fatigue characteristic and formability, which is characterized by a composite structure composed of polygonal ferrite and bainite and containing from 0.01 to 0.15% by weight of C, from 0.01 to 1.5% by weight of Si and from 0.3 to 2.0% by weight of Mn, the area ratio of the bainite being from 3 to 60%.

The present invention also provides a process for producing such a steel sheet, which is characterized by hot rolling a steel having the above mentioned composite structure, upon completion of the hot rolling, cooling the hot rolled steel sheet for from 3 to 20 seconds at a cooling rate of from 4 to 10° C./sec., then cooling it at a cooling rate of from 50° C. to 100° C./sec., and winding it up at a temperature of from 350° to 575° C. In a modification of the process, the hot rolled sheet is cooled for from 1 to 10 seconds at a cooling rate of from 20° to 50° C./sec. prior to the cooling for 3 to 20 seconds at the cooling rate of from 4° to 10° C./sec.

The above mentioned object and other objects of the present invention as well as the construction and features of the invention will become apparent from the following detailed description of the invention.

DETAILED DESCRIPTION OF THE PREFERRED EMBODIMENTS

Figure 1:
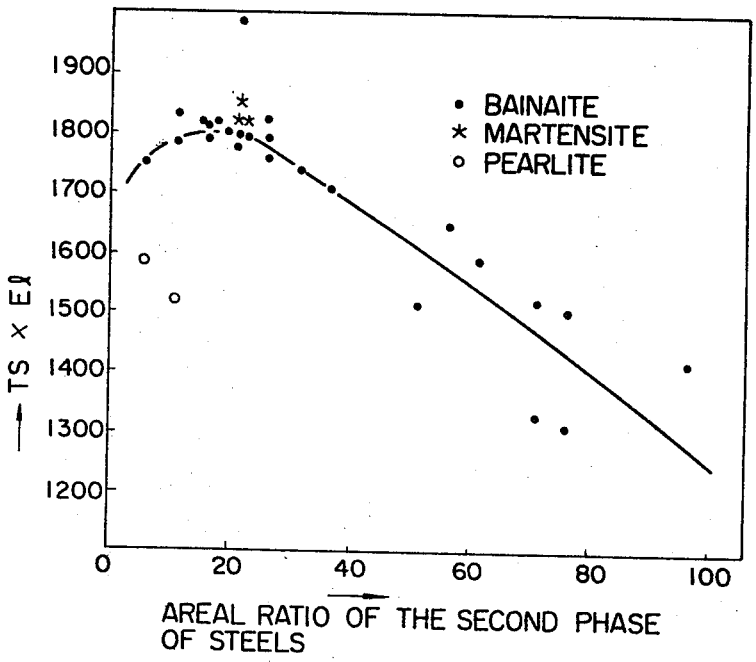
FIG. 1 is a graph showing a relation between an areal ratio of the second phase of steels and a strength-elongation balance.

The high strength steel sheet of the present invention is characterized by the composite structure composed of polygonal ferrite and bainite and containing from 0.01 to 0.15% by weight of C, from 0.01 to 1.5% by weight of Si, and 0.3 to 2.0% by weight of Mn, the areal ratio of the bainite being from 3 to 60%, and it has excellent flash butt weldability, fatigue characteristic and formability which are required for application to wheel rims or discs. The steel sheet of the present invention may optionally further include from 0.01 to 1.5% by weight of Cr, from 0.01 to 0.08% by weight of Nb, from 0.02 to 0.6% by weight of V, from 0.01 to 0.08% by weight of Ti, from 0.02 to 0.18% by weight of Zr, from 0.05 to 0.2% by weight of Mo, from 0.0005 to 0.005% by weight of B, from 0.1 to 0.5% by weight of Ni, from 0.1 to 0.5% by weight of Cu, from 0.02 to 0.15% by weight of P, from 0.0005 to 0.01% by weight of Ca, from 0.0005 to 0.01% by weight of Mg or from 0.005 to 0.1% by weight of a rare earth element, as the case requires.

Any method may be used for the production so long as it produces a structure of the steel of the present invention, i.e. a structure composed of a polygonal ferrite phase and a bainite phase having an areal ratio of from 3 to 60%. A heat treatment method or a method of hot rolling per se, may be used. When the production is carried out by the hot rolling per se, the hot rolling conditions are determined depending upon the chemical composition of the steel to be treated, and it is required to satisfy two conditions: that a desired proportion of ferrite be given and that the second phase be bainite.

In the case of a composition system where Mn and Cr contents are low and the ferrite formation is fast, the desired proportion of ferrite is obtainable by a cooling pattern of gradual cooling followed by rapid cooling in such a manner that upon completion of the hot rolling, the hot rolled sheet is cooled at a cooling rate of from 4° to 10° C./sec. for from 3 to 20 seconds and then at a cooling rate of from 50° to 100° C./sec. However, in the case of a steel having high C, Mn and Cr contents, no adequate proportion of ferrite is obtainable by the above cooling pattern. Accordingly, in such a case, it is desirable to use a cooling pattern wherein the gradual cooling is carried out in a temperature range in which the ferrite formation is fastest, in such a manner that upon completion of the hot rolling, the hot rolled sheet is cooled at a cooling rate of from 20° to 50° C./sec. for from 1 to 10 seconds, then gradually cooled at a cooling rate of from 4° to 10° C./sec. and thereafter rapidly cooled at a cooling rate of from 50° to 100° C./sec.

In both cases, the hot rolled sheet is rapidly cooled from the gradual cooling region and wound up at a temperature of from 350° to 575° C., and this is a procedure necessary to transform non-transformed austenite to bainite. If the winding-up temperature exceeds 575° C., pearlite or cementite is likely to form, and if the temperature is lower than 350° C., martensite is likely to be incorporated. These structures tend to lead to a degradation of the excellent flash butt weldability, fatigue characteristic and formability, and therefore, such conditions should be avoided.

Referred to the chemical composition, the amount of C is at least 0.01% by weight to provide adequate strength and hardenability. However, if the amount is too much, the hardness is decreased by the decarburization at the welding surfaces at the time of the flash butt welding, resulting in an unbalance of hardness between the welded line and its vicinity. Accordingly, the upper limit of the carbon content is 0.15% by weight, preferably about 0.12% by weight, and more preferably it is about 0.09% by weight. However, in a case where the steel is used for wheel discs which do not require such a characteristic, the upper limit may be 0.15% by weight.

Mn is an essential element to complement the strength decreased due to a decrease of the carbon content and to form a bainite structure. If the amount is less than 0.3% by weight, no adequate strength and structure are obtainable, and on the other hand, if the amount exceeds 2.0% by weight, there will be some difficulties in smelting, and the ductility will be degraded. Thus, Mn is added in an amount within a range of from 0.3 to 2.0% by weight. In a case where the steel sheet is produced as hot rolled, it is preferred to limit the Mn content within a range of from 0.5 to 1.5% by weight to obtain the desired structure.

Si is an element which is useful for facilitating the formation of the polygonal ferrite and for obtaining a proper structure. Further, it is an element suitable to provide a high strength and a high ductility. For these purposes, it is necessary to add Si in an amount of at least 0.01% by weight.

Cr serves to improve hardenability and to facilitate the formation of the bainite structure. In order to obtain such effectiveness, it is necessary to add Cr in an amount of at least about 0.01% by weight. However, if the amount exceeds about 1.5% by weight, the effectiveness is saturated. If the amount is excessive, the desired ferrite proportion is not obtainable when the steel of the present invention is produced by hot rolling. Accordingly, the upper limit is about 1.5% by weight.

Nb, V, Ti and Zr are elements effective to prevent the decomposition of the bainite structure at the portion thermally affected by the flash butt welding and to prevent a decrease of the hardness, and they are essential elements for a steel used for wheel rims. Further, these elements have a precipitation enhancing effectiveness and accordingly they serve as complementary elements to improve the strength. However, if they are added excessively and the precipitation enhancing amount is thereby increased too much, the ductility will be degraded and the precipitated substance is likely to be re-dissolved at the thermally affected portion to cause softening. Accordingly, it is proper to incorporate at least one of them within the respective ranges of from 0.01 to 0.08% by weight of Nb, from 0.02 to 1.5% by weight of V, from 0.01 to 0.08% by weight of Ti, and from 0.02 to 0.18% by weight of Zr. In addition to their common effectiveness, Nb gives a certain influence over the transformation behaviour of the structure after the hot rolling and it is the most useful element for the formation of the bainite structure. Ti and Zr are effective to prevent the formation of a sulfide which is harmful to the ductility. V is an element effective to properly harden the welded center portion ($Hv \approx 25$) relative to the hardness of the substrate material.

According to the present invention, other than the above mentioned components, there may be added the following elements as the case requires:

Mo is an element effective to improve the hardenability, and to provide the desired structure. For these pruposes, Mo is added at least about 0.05% by weight. However, if the amount exceeds about 0.2% by weight, the effectiveness reaches its saturation. Accordingly, the upper limit is about 0.2% by weight.

Likewise, B is an element effective to improve the hardenability and to provide the desired structure, and therefore, it is added in an amount within a range of from 0.0005 to 0.005% by weight. In order to obtain the effectiveness of B, it is preferred to use it in combination with Ti and Zr.

Ni, Cu and P are elements effective to improve the corrosion resistance. Ni and Cu are added in the respective amounts of from 0.1 to 0.5% by weight of Ni, and from 0.1 to 0.5% by weight of Cu. P serves to improve the corrosion resistance especially when it is used in combination with Ni and Cu, and it is added in an amount within a range of 0.002 to 0.15% by weight.

A rare earth element (REM), and Ca or Mg, are effective to make a sulfide inclusion harmless due to their effectiveness to control the form of sulfides, and in improving formability formability. In order to obtain this effect, they are added in their respective amounts within ranges of from 0.005 to 0.1% by weight of REM, from 0.0005 to 0.01% by weight of Ca and from 0.0005 to 0.01% by weight of Mg. They may be added alone or as a combination of two or more. However, if the amounts are excessive, they tend to adversely affect the purity and the ductility. Accordingly, the upper limit of the total amounts is preferably set to be about 0.1% by weight.

Further, Al is added in an amount of at least 0.06% by weight as a deoxidizer at the time of smelting. S should preferably be limited to less than 0.02% by weight.

Figure 2:
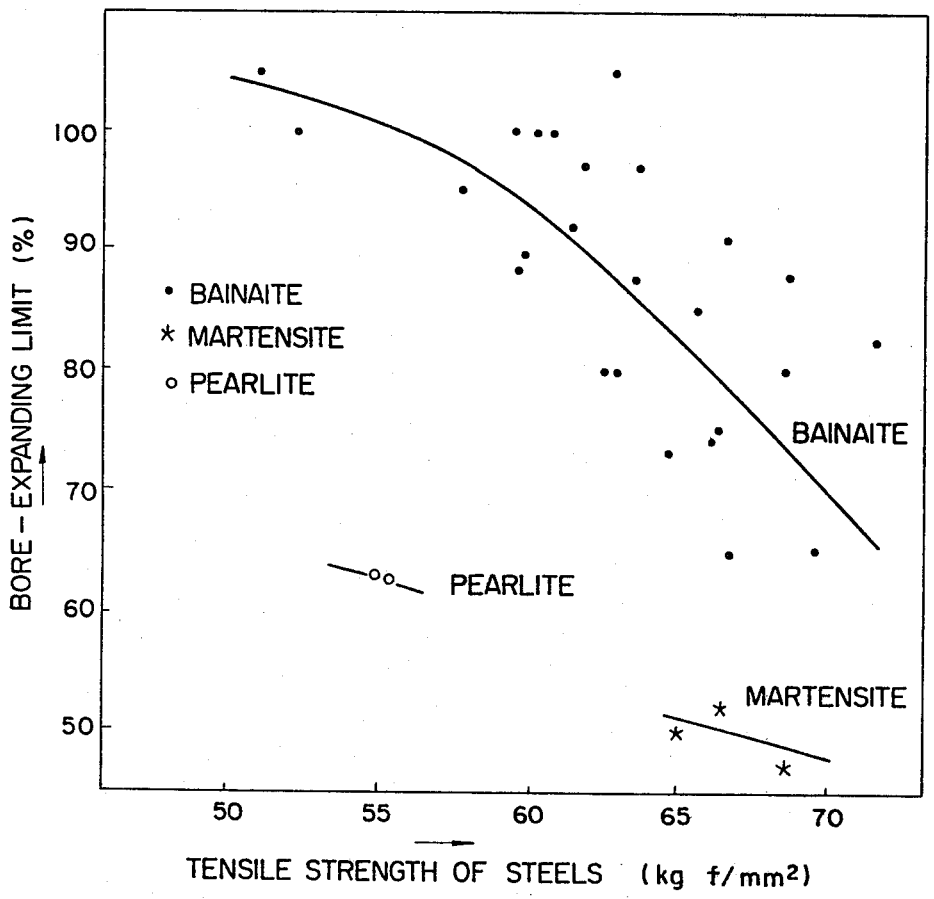
FIG. 2 is a graph showing a relation between the tensile strength of steels and the bore-expanding limit.

Now, the structure of the steel of the present invention will be described. It is apparent from FIGS. 3 and 4 of the Examples given below that the steel with the structure of ferrite plus bainite has superior resistance weldability (especially without softening of the thermally affected portion), and fatigue characteristic to the conventional ferrite plus martensite (dual phase) steel. With respect to the formability, the stretch-flanging property of the ferrite plus bainite steel is much superior to a ferrite plus martensite steel or a ferrite-pearlite steel as shown in FIG. 2. The strength-elongation balance is closely related to the areal ratio of the bainite, as shown in FIG. 1, and the best characteristic is obtainable at an areal ratio of from 10 to 20%. If the areal ratio of bainite is within a range of from 5 to 30%, the value of the strength-elongation balance is at least 1750, and that means that the steel can be formed into practically all kinds of formed articles. Further, if the areal ratio of bainite is within a range of the present invention i.e. from 3 to 60%, a steel having superior characteristics to those of usual high strength low alloy steels is obtainable.

In the present invention, the bainite includes lower bainite and upper bainite (BII, BIII) which are accompanied by a precipitation reaction of carbides, as well as a structure which is referred to as BI, Widmanstatten or acicular ferrite and which is not accompanied by a carbide reaction. However, so far as the stretch-flanging property is concerned, the upper bainite among various bainite structures, exhibits a superior characteristic.

Now, the process for producing the steel sheet by hot rolling according to the present invention will be described.

A steel slab having a predetermined composition is hot rolled by a usual method. After the hot rolling, the rolled sheet is firstly cooled at a cooling rate of from 4° to 10° C./sec. for from 3 to 20 seconds to form ferrite having a desired areal ratio. This cooling rate is a rate under no water supplying condition and is adjusted to fall within the range of from 4° to 10° C./sec. by selecting the thickness of the sheet and the ambient temperature. The cooling time is the time required for obtaining the desired ferrite proportion. If it is less than 3 seconds, the formation of ferrite will be inadequate, and the cooling time of longer than 20 seconds is not advantageous from the practical point of view.

This first cooling is followed by a cooling (i.e. a second cooling) down to from 350° to 575° C. at an average cooling rate of from 50° to 100° C./sec. to transform non-transformed austenite to bainite. Then, the steel sheet is wound up at the same temperature. If this cooling rate is less than 50° C./sec., there is a possibility of undesirable formation of pearlite. On the other hand, it is practically difficult to bring the cooling rate higher than 100° C./sec.

In the case of a steel having a composition system with a high C, Mn and/or Cr content, the above mentioned cooling cycle may not give a desired ferrite proportion. In such a case, a method is employed wherein gradual or slow cooling is carried out in a temperature range within which ferrite formation is fastest.

Namely, upon completion of the hot rolling, the rolled sheet is rapidly cooled to that temperature range at a cooling rate of from 20° to 50° C./sec. for from 1 to 10 seconds and then gradually cooled at a cooling rate of from 4° to 10° C./sec. for from 3 to 20 seconds. The gradual cooling temperature range varies depending upon the chemical composition of the steel, and in most cases, it is about from 650° to 700° C. Thereafter, the steel sheet is cooled at a cooling rate of from 50° to 100° C. down to from 350° to 575° C. and it is then wound up at the same temperature.

Now, Examples of the present invention will be given together with Comparative Examples.

Steels having chemical compositions listed in Table 1 were smelted, then formed into a sheet having a thickness of 3.2 mm by hot rolling (finishing temperature: from 800° to 855° C.) and (1) cooled at a cooling rate of from 4° to 10° C./sec. for 3 to 20 seconds, and then at a cooling rate of from 50° to 100° C./sec. and wound up at a temperature of from 350° to 575° C., or (2) cooled at a cooling rate of from 20° to 50° C./sec. for from 1 to 10 seconds, then gradually cooled at a rate of from 4° to 10° C. for from 3 to 20 seconds, then rapidly cooled at a rate of 50° to 100° C./sec., and wound up at a temperature of from 350° to 575° C., actually at a temperature of about 450° C.

Figure 3:
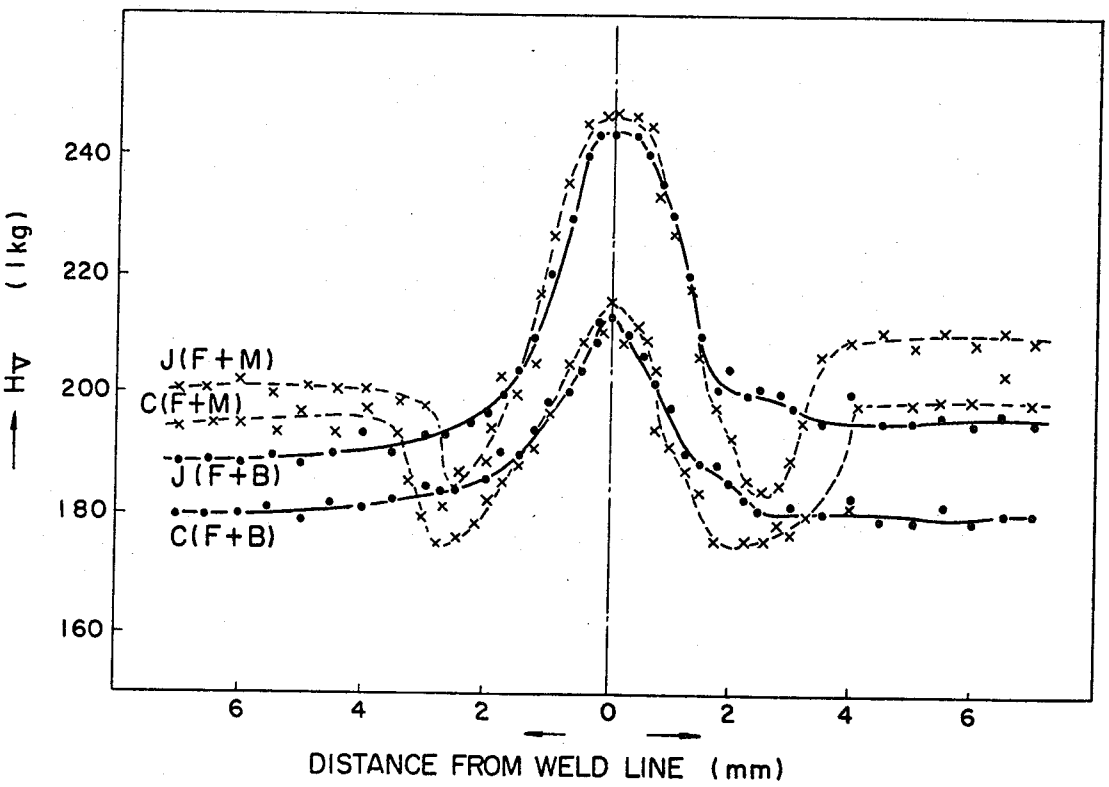
FIG. 3 is a graph showing a hardness distribution at a flash butt welded zone of steels.
Figure 4:
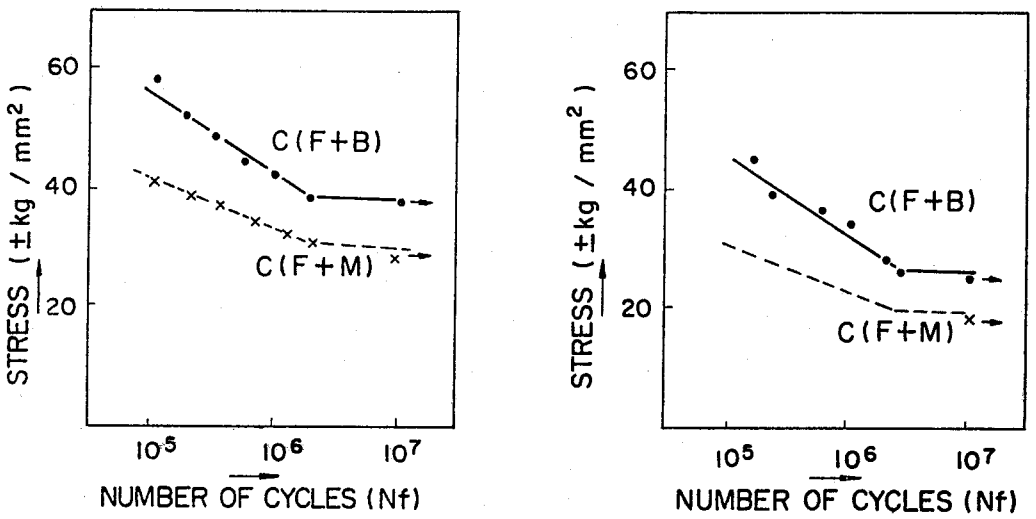
FIG. 4 is a graph showing the results obtained by Schenck fatigue tests of steels.

The actual cooling and winding-up conditions were as shown in Table 2. Table 2 also show the results obtained by the microscopic determination of the structures of the hot rolled steels thereby obtained, and the results obtained by the measurement of their mechanical properties. FIG. 1 shows the strength-elongation balance. FIG. 2 shows the stretch-flanging property. FIG. 3 shows the hardness distribution at the flash butt welded zone. FIG. 4 shows results obtained by Schenck fatigue tests. With respect to FIG. 3, the flash butt welding conditions were as follows:

Welding conditions:
Flash distance: 3 mm
Flash period: 3 seconds
Upset distance: 3 mm
Upset period: 2/60 seconds
Upset speed: 150 mm/sec.
Steel sheet size: 30 mm (width)×75 m (length)×3.2 mm (thickness)

TABLE 1

| Steels | Chemical Compositions (% by weight) C | Si | Mn | P | S | Al | Nb | balance Fe and; |
|---|---|---|---|---|---|---|---|---|
| Steels of the present invention | | | | | | | | |
| A | 0.05 | 0.55 | 1.45 | 0.010 | 0.007 | 0.03 | — | |
| B | 0.05 | 0.60 | 1.07 | 0.007 | 0.007 | 0.02 | — | |
| C | 0.05 | 0.74 | 1.33 | 0.009 | 0.007 | 0.03 | 0.021 | |
| D | 0.07 | 0.95 | 1.48 | 0.006 | 0.006 | 0.02 | 0.025 | |
| E | 0.09 | 0.50 | 0.53 | 0.008 | 0.005 | 0.03 | 0.020 | |
| F | 0.12 | 0.35 | 0.68 | 0.009 | 0.006 | 0.03 | 0.025 | |
| G | 0.06 | 0.75 | 1.65 | 0.012 | 0.006 | 0.03 | 0.021 | |
| H | 0.06 | 0.50 | 0.85 | 0.010 | 0.005 | 0.03 | 0.018 | Cr 0.20 |
| I | 0.05 | 0.71 | 1.15 | 0.012 | 0.007 | 0.03 | 0.010 | V 0.06 |
| J | 0.10 | 0.48 | 0.65 | 0.008 | 0.006 | 0.03 | 0.010 | Ti 0.05 |
| K | 0.05 | 0.05 | 1.48 | 0.011 | 0.005 | 0.02 | 0.015 | Cr 0.10 Mo 0.21 |
| L | 0.05 | 0.35 | 1.50 | 0.015 | 0.005 | 0.02 | 0.025 | Cr 0.38 B 0.0008 Ti 0.022 |
| M | 0.10 | 0.50 | 0.65 | 0.010 | 0.007 | 0.03 | 0.020 | Cu 0.25 P 0.05 |
| Comparative steels | | | | | | | | |
| N | 0.20 | 0.50 | 0.55 | 0.010 | 0.004 | 0.04 | 0.021 | |
| O | 0.04 | 2.00 | 0.95 | 0.009 | 0.007 | 0.03 | 0.018 | |
| P | 0.07 | 0.55 | 2.35 | 0.012 | 0.007 | 0.03 | 0.024 | |
| Q | 0.05 | 0.50 | 1.20 | 0.006 | 0.008 | 0.03 | 0.020 | Cr 1.75 |

TABLE 2

Hot Rolling Conditions & Mechanical Properties of the Obtained Steel Sheets

| Steels | Cooling[1] Patterns | Winding-up Tempera-tures(°C.) | Struc-[2] tures | YP[3] (Kg f/mm²) | TS[3] (Kg f/mm²) | El[3] (%) | TS × EL | Bore Expan-sion Ratios | VTrS[5] (°C.) | vES[5] (Kg-m) | Location[6] of Fractures | Result[7] |
|---|---|---|---|---|---|---|---|---|---|---|---|---|
| A | 2 | 450 | 85% F + B | 33.4 | 52.1 | 34.4 | 1793 | 100 | −160 | 1.85 | HAZ | o |
| B | 1 | 450 | 90% F + B | 31.4 | 50.8 | 35.2 | 1788 | 105 | −165 | 1.88 | HAZ | o |
| C | 2 | 450 | 80% F + B | 46.7 | 59.1 | 30.0 | 1775 | 100 | −150 | 2.05 | Mastersheet | o |
| | 1 | 450 | 75% F + B | 46.9 | 60.0 | 29.3 | 1760 | 100 | −145 | 2.00 | " | o |
| C' | * | 650 | 95% F + P | 48.2 | 55.2 | 28.7 | 1585 | 65 | −120 | 1.30 | " | X |
| C'' | * | 450 | 30% F + B | 45.3 | 59.6 | 25.5 | 1520 | 89 | −155 | 1.90 | " | X |
| C''' | * | 60 | 80% F + M | 37.7 | 65.0 | 28.0 | 1823 | 50 | −100 | 1.25 | HAZ | X |
| D | 2 | 450 | 90% F + B | 44.3 | 57.5 | 31.8 | 1829 | 95 | −150 | 1.88 | Mastersheet | o |
| D' | * | 450 | 25% F + B | 49.3 | 62.4 | 24.1 | 1505 | 80 | −150 | 1.75 | " | X |
| E | 1 | 400 | 85% F + B | 47.6 | 59.5 | 30.4 | 1810 | 88 | −175 | 2.20 | " | o |
| F | 1 | 450 | 80% F + B | 51.5 | 66.0 | 27.2 | 1795 | 74 | −145 | 1.85 | " | o |
| F' | * | 650 | 90% F + P | 46.5 | 54.8 | 27.7 | 1520 | 63 | −110 | 1.33 | " | X |
| F'' | * | 100 | 80% F + M | 49.4 | 68.6 | 26.4 | 1814 | 47 | −110 | 1.21 | HAZ | X |
| G | 2 | 475 | 75% F + B | 45.9 | 64.5 | 28.3 | 1825 | 73 | −145 | 1.88 | Mastersheet | o |
| G' | * | 450 | 45% F + B | 47.2 | 68.3 | 24.2 | 1650 | 80 | −150 | 1.90 | " | X |
| H | 1 | 450 | 75% F + B | 49.8 | 65.4 | 27.4 | 1790 | 85 | −160 | 1.95 | " | o |
| | 2 | 450 | 85% F + B | 48.5 | 63.2 | 28.8 | 1820 | 87 | −160 | 1.95 | " | o |
| I | 1 | 450 | 80% F + B | 49.4 | 61.2 | 29.4 | 1800 | 92 | −150 | 2.12 | " | o |
| J | 1 | 500 | 80% F + B | 46.2 | 61.6 | 29.1 | 1790 | 97 | −155 | 2.00 | " | o |
| J' | * | 60 | 80% F + M | 40.5 | 66.3 | 28.0 | 1856 | 52 | −125 | 1.25 | HAZ | X |
| K | 2 | 400 | 70% F + B | 48.7 | 62.5 | 27.8 | 1740 | 80 | −160 | 1.85 | Mastersheet | o |
| K' | * | 400 | 40% F + B | 52.3 | 66.2 | 24.0 | 1590 | 75 | −155 | 1.80 | " | X |
| L | 2 | 450 | 65% F + B | 51.0 | 66.5 | 25.7 | 1710 | 65 | −140 | 1.75 | " | o |
| L' | * | 450 | 5% F + B | 56.2 | 69.4 | 20.5 | 1420 | 65 | −145 | 1.85 | " | X |
| M | 1 | 500 | 85% F + B | 49.0 | 62.5 | 29.1 | 1820 | 105 | −160 | 1.75 | " | o |
| | 2 | 550 | 95% F + B | 48.1 | 60.4 | 29.0 | 1750 | 100 | −165 | 1.70 | " | o |
| N | 1 | 450 | 50% F + B | 57.1 | 71.4 | 21.2 | 1516 | 85 | −120 | 1.58 | " | X |
| O | 1 | 450 | 80% F + B | 48.9 | 63.5 | 31.3 | 1990 | 97 | −115 | 1.49 | " | X |
| P | 1 | 450 | 25% F + B | 55.8 | 68.5 | 19.1 | 1311 | 88 | −130 | 1.68 | " | X |
| Q | 1 | 450 | 30% F + B | 54.4 | 66.4 | 20.0 | 1325 | 91 | −140 | 1.80 | " | X |

*[1]1: Cooling pattern of claim 11, 2: Cooling pattern of claim 12, and *3: Other cooling patterns
*[2]F: ferrite, B: bainite, M: martensite, and P: pearlite plus cementite
*[3]ASTM E8 Standard Size
*[4]Initial bore: Punched bore of 30 mmϕ, Punch: Conical punch of 90ϕ and 30°
*[5]JIS No. 4, ¼ Size, C-direction
*[6]Location of the fractures (HAZ: heat affected zone) when the flash butt welded zones were subjected to a tensile test after the flash removal and grinding
*[7]o: Good, X: No good Further, steels having a composition corresponding to steel C were smelted, and hot rolled steel sheets having a thickness of 3.0 mm were produced and formed into wheel rims and wheel discs. The steel of the present invention was produced according to the hot rolling condition (1). The comparative ferrite-pearlite steel was produced by a usual hot rolling process and wound up at a temperature of 650° C. The dual phase steel was produced by a heat treatment.

The properties of these steels and their failure ratios when applied to wheel rims and discs are shown in Table 3.

TABLE 3

Results of the Formation into Rims and Discs

| Struc-tures | Y.P.* (kg f/mm²) | T.S.* (kg f/mm²) | El* (%) | Failure ratios of rims | Failure ratios of discs | Notes |
|---|---|---|---|---|---|---|
| 80% F-B | 47.3 | 61.2 | 30.5 | 1.0 | 0.5 | Steels of the present invention |
| 80% F-M | 38.0 | 65.2 | 29.4 | 30.0 | 1.5 | Comparative steel |
| 95% F-P | 49.9 | 58.8 | 27.4 | 10.0 | 5.0 | Comparative steel |

*ASTM E8 Standard Size

What is claimed as new and desired to be secured by Letters Patent of the United States is:

1. A method of producing high strength, hot rolled, steel sheet with excellent flash butt weldability, fatigue characteristic and formability, having a composite structure consisting of polygonal ferrite and bainite, and containing from 0.01 to 0.15% by wt of C, from 0.01 to 1.5% by wt of Si, and from 0.3 to 2.0% by wt of Mn, the area ratio of the bainite being from 3 to 60%, said steel sheet being produced by a cooling treatment consisting of: upon completion of the hot rolling, cooling the hot rolled steel sheet for 3 to 20 seconds at a cooling rate of 4° to 10° C./sec; thereafter cooling the steel sheet at a cooling rate of 50° to 100° C./sec, and winding up the sheet thus cooled at a temperature of from 350° to 575° C.

2. A method of producing high strength, hot rolled, steel sheet with excellent flash butt weldability, fatigue characteristics and formability, having a composite structure consisting of polygonal ferrite and bainite, and containing from 0.01 to 0.15% C, from 0.01 to 1.5% by wt of Si and from 0.3 to 2.0% by wt of Mn, the area ratio of the bainite being from 3 to 60%, said steel sheet being produced by a cooling treatment consisting of: upon completion of the hot rolling, cooling the hot rolled steel sheet for 1 to 10 seconds at a cooling rate of 20° to 50° C./sec; then gradually cooling the steel sheet for 3 to 20 seconds at a cooling rate of 4° to 10° C./sec; thereafter, rapidly cooling the steel sheet at a cooling rate of 50° to 100° C./sec, and winding up the sheet thus cooled at a temperature of from 350° to 575° C.

3. The method according to claim 1 or 2, wherein the area ratio of the bainite is from 5 to 30%.

4. The method according to claim 1 or 2, wherein the bainite is upper bainite.

5. The method according to claim 4, wherein the bainite is upper bainite.

6. The method according to claim 1 or 2, wherein the steel sheet further contains from 0.01 to 1.5% by wt of Cr.

7. The method according to claim 1 or 2, wherein the steel sheet further contains at least one member selected from the group consisting of from 0.01 to 0.08% by wt of Nb, from 0.02 to 0.6% by wt of V, from 0.01 to 0.08% by wt of Ti, and 0.02 to 0.18% by wt of Zr.

8. The method according to claim 1 or 2 wherein the steel sheet further contains at least one member selected from the group consisting of from 0.05 to 0.2% by wt of Mo and from 0.0005 to 0.005% by wt of B.

9. The method according to claim 1 or 2, wherein the steel sheet further contains at least one member selected from the group consisting of from 0.1 to 0.5% by wt of Ni, from 0.1 to 0.5% by wt of Cu and from 0.02 to 0.15% by wt of P.

10. The method according to claim 1 or 2, wherein the steel sheet further includes at least one member selected from the group consisting of from 0.0005 to 0.01% by wt of Ca, from 0.0005 to 0.01% by wt of Mg and from 0.005 to 0.1% by weight of a rare earth element.

* * * * *